US006745420B2

(12) United States Patent
Giori et al.

(10) Patent No.: US 6,745,420 B2
(45) Date of Patent: Jun. 8, 2004

(54) ADJUSTABLE FOAM AND COIL SPRING MATTRESS COMBINATION

(76) Inventors: Gualtiero G. Giori, 4333 SW. 26th Ct., Cape Coral, FL (US) 33914; Janine Giori, 4333 SW. 26th Ct., Cape Coral, FL (US) 33914

( * ) Notice: Subject to any disclaimer, the term of this patent is extended or adjusted under 35 U.S.C. 154(b) by 0 days.

(21) Appl. No.: 10/244,480

(22) Filed: Sep. 17, 2002

(65) Prior Publication Data

US 2003/0009831 A1 Jan. 16, 2003

Related U.S. Application Data

(63) Continuation-in-part of application No. 10/016,722, filed on Oct. 30, 2001, now abandoned, which is a continuation-in-part of application No. 09/800,752, filed on Mar. 7, 2001, now abandoned.

(51) Int. Cl.[7] ..... A47C 27/10

(52) U.S. Cl. ..... 5/709; 5/710; 5/654; 5/655.1

(58) Field of Search ..... 5/709, 710, 420, 5/740, 953, 654, 655.1

(56) References Cited

U.S. PATENT DOCUMENTS 2,779,034 A * 1/1957 Arpin ..... 5/697
4,371,997 A * 2/1983 Mattson ..... 5/709
6,269,505 B1 * 8/2001 Wilkinson ..... 5/713

* cited by examiner

*Primary Examiner*—Teri Pham Luu
*Assistant Examiner*—Fredrick Conley
(74) *Attorney, Agent, or Firm*—William E. Noonan

(57) ABSTRACT

The invention modulates the air-volume in both mattress-type foam and traditional coil spring cores interactively, obtaining a wide variety of levels of density and indentation force deflection (IFD or spring-back force). Foam core modulation is used to soften or harden the upper surface of the combined two elements to form enhanced-comfort support surfaces. The combinations include multiple chambers of which at least one is filled with self-inflating foam. In most configurations of the present invention, the chambers are completely sealed and are not air communicable with each other. Each chamber is fitted with a valve used to selectively withdraw air from it—but never to pressurize it by adding air forcibly. The combinations of core layers include traditional coil spring cores that may or may not be completely enclosed in their own enclosure. When air is extracted from a self-inflating foam core, its surface softens uniformly, density increases while its IFD value drops. When air is extracted from a layer containing traditional coil springs, however, the surface hardens and the IFD value increases, because the compressed coils want to spring back to their original relaxed position. The invention takes advantage of the unique interactive behavior of self-inflating foam and coil spring constructions to create multiple levels of comfort for one or more users of the same device. It is intended for all types and forms of support apparatuses, such as mattresses, seats and cushions.

24 Claims, 12 Drawing Sheets

PRIOR ART TRADITIONAL MULTI FOAM ZONES AND COIL SPRING MATTRESS

ADJUSTABLE FOAM AND COIL SPRING MATTRESS COMBINATION

CROSS REFERENCE TO RELATED APPLICATIONS

This Application is a Continuation-In-Part of application Ser. No. 10/016,722 now ABANDONED having a filing date of Oct. 30, 2001 which in turn is a Continuation-In-Part of application Ser. No. 9/800,752 having a filing date of Mar. 7, 2001 now ABANDONED.

STATEMENT REGARDING FED SPONSORED R & D (none)

FIELD OF THE INVENTION

This invention relates to an interactively modulable support apparatus, such as a mattress, having a layer of pressure adjustable self-inflating, open-cell, flexible polyurethane foam core and a layer of mattress spring coils. Both layers are independently adjustable as to softness/hardness, but also interactively modulable in the way that adjustment of the foam core layer modifies the characteristics of the coil spring layer.

BACKGROUND OF THE INVENTION

This invention is a multiple layer combination mattress. One or more layers are self-inflating elastomeric open-cell polyurethane foam and another layer is a section having mechanical coil springs therein. Both layers are individually, as well as interactively adjustable as to their hardness and softness (indentation force deflection—IFD) and support (density).

Various designs have been made in the past to control the hardness, softness, and support firmness of foam layers within a mattress by using different zones of foam layers for different parts of the body, or by controlling the firmness or responsiveness of coil springs in mattresses, but to control both layers so that they can be adjusted by the user, foam and coil independently and interactively in one mattress, has not been achieved and is not found in the prior art in the manner of this invention.

U.S. Pat. No. 2,779,034 to Arpin discloses a firmness adjustment for mattresses involving a standard coil spring mattress wherein standard coil springs are enclosed by a loosely fitting airtight cover. A vacuum pump can be applied to the cover in order to compress the coil springs within the mattress to make them harder. Although the disclosure of Arpin mentions 'rubber foam' or similar material, it does not involve any open-cell, self-inflating foam varieties, nor does Arpin teach that the respective density and IFD values, which are determined by the cellular structure of the foam or foam-like material he may have had in mind, may be modulated to result in a softer or harder mattress without sacrificing support-firmness in the process of multiple comfort adjustments. The present invention, however, modulates the foam core layers' characteristics in a way as to bring pressure resulting from that modulation to bear onto the coil spring layer, thus interactively and incrementally increasing this layer's firmness in a predetermined range of modulation, whereas Arpin only applies a vacuum to the coil spring section to increase indentation force deflection (increasing firmness) of the coil spring layer.

A further fundamental difference lies in the fact that the present teaching does the opposite and still at the same time increases support. This effect is achieved by utilization of the properties of special foam material which is manufactured and applied expressly for the purpose of modulating indentation force deflection and density from maximum firm state to a chosen state of softness without weakening the desirable effect of high support.

U.S. Pat. No. 3,611,524 illustrates a method of assembling a mattress. The disclosure involves a ready-made mattress either of the coil spring type or foam type which is initially wrapped in an airtight sheet of plastic and a vacuum pump is applied to the wrapped combination and the coil spring mattress or the foam mattress will collapse under the force of the vacuum and either of the collapsed forms can now be inserted into a finishing cover. Once the vacuum in either mattress is released, either one of the mattresses will expand to snugly fit within the outer covering. This disclosed invention is designed for a one time use only. Moreover, there is a teaching within this reference that the preliminary wrapping sheet should be removed. In contrast to this, the invention at hand can be used time and time again to adjust the various levels of firmness desired. No disclosure within U.S. Pat. No. 3,611,524 is made that the aim is to adjust comfort levels. A manufacturing process is described wherein a filling material is reduced in volume by removing air from it to be able to quickly and efficiently introduce it in a sleeve before it has time to expand again. This method is now used worldwide by upholsterers and furniture manufacturers.

U.S. Pat. No. 3,872,525 to Lea discloses a camping mat using a self-inflating foam within an airtight outer cover that is vulcanized to the inner foam layer. The air within can be removed by compressing the structure whereby the foam layer collapses, allowing the mat to be rolled up into a compact package. The firmness (IFD) or density can not be modulated freely because of the thinness and light weight of the foam layer used in camping mats. Furthermore, compressing the camping mat by hand does not expel the air uniformly from all the foam cells but only in the area being compressed by hand. Clearly, modulating comfort and firmness were not in the mind of the inventors, but a method of decreasing the mat's volume for easy packing and transport The invention at hand uses a thicker, higher density foam core to start with, which can be adjusted infinitely to multiple levels of firmness and support not found in the prior art and thus adjusts the coil spring layer accordingly. Its priority lies with comfort modulation and should not be considered a method of packaging a camping mat into a small size to be carried in a backpack.

U.S. Pat. No. 4,025,974 discloses a self-inflating air mattress/mat including an airtight flexible envelope which encloses a core of resilient, open cell, lightweight foam material, substantially the entire upper and lower portions of which are bonded to the envelope. Heated platens are applied to this lay-up, followed by creating a vacuum in the interior, cooling and pressurizing the assembly, then moderately pressurizing the whole. The invention at hand does not bond any outer coverings to the enclosed foam layer. On the contrary, this invention uses a device to distance the foam from the cover in order to enhance airflow and to prevent the foam or cover from obstructing the valve when air is drawn out of the mattress or when it is self-inflating.

Again, the aim of the teaching in this patent is to compress the mat for easy transport in a backpack. Furthermore, there is no indication of a further objective to intentionally modulate the foam density or IFD within the foam core with the aid of a vacuum to obtain multiple levels of firmness and support. Lastly, Lea proposes to utilize foam types with a density not greater than 1.2 or 1.5 in their original state. No mention is made of interactivity with other mattress layers.

U.S. Pat. No. 4,711,067 teaches the packaging of a mattress wherein the thickness of an elastic structure of a mattress is reduced. An extra cover is fitted over the mattress which is fitted over the structure of a pressing device. This procedure will completely flatten the mattress for roll-up. There is no disclosure to control any comfort level or to apply a vacuum pump to do so, nor of any interactivity with other mattress layers.

U.S. Pat. No. 4,944,060 illustrates a mattress having a plurality of discrete, air permeable cells which are to some extent hydrophobic. In opposition to the invention at hand there is no block of a foam core of any kind, no covering encasing or envelope and there is no teaching of complete air evacuation, nor mention of interactivity with other mattress layers.

The invention at hand does not use any pressurized air but a vacuum only, whereas the above art teaches the opposite, namely pressurization of a chamber to increase the hardness of the support surface. If air were allowed to escape from the chamber, the support surface would collapse and cause a hammock effect.

In the invention at hand interactive foam core never exhibits a collapsing hammock effect when air is removed from within the foam cells, but adjusts to the body's pressure points locally as density within the foam core increases to offer more support, and exerts less pressure on the adjacent coil spring layer to also increase softness and comfort.

U.S. Pat. No. 5,947,168 illustrates a method and apparatus for rapidly deflating and substantially emptying an inflatable air chamber, the chamber being a mattress. This disclosure does not involve any self-inflating alternating density polyurethane foam and therefore, is not pertinent to the invention at hand.

U.S. Pat. No. 6,098,378 discloses a method of packaging a single mattress to a small size to be conveniently carried. In this method and apparatus, the foam mattress is compressed to fit into a hard container for shipment. At the point of sale, the mattress is extracted and expands to its original shape. This appears as a one time use only and there is no teaching of adjusting the comfort level of a user through modulation of pressure.

Furthermore, none of the above prior art teachings take advantage of the expanding force of a self-inflating foam core that while it is in the process of expanding, compresses an adjacent core and modifies the properties of that core.

SUMMARY OF THE INVENTION

The invention results from the realization that a combination of a self-inflating, adjustable density, variable IFD, open-cell flexible polyurethane foam core with a mattress layer having coils therein greatly enhances the versatility of this mattress combination, offering great variety in adjustable levels of comfort.

The invention teaches how the Indentation Force Deflection (IFD) and density properties of a certain quality range of flexible open-cell polyurethane foam can be modulated by removing some of the air from within the foam cells and altering the cellular structure of the foam core. High density foam is more expensive (such as visco-elastic foam). They provide great comfort. The focal teaching of this invention is how to modulate a comparatively inexpensive, lower density foam to feel similar to a high density foam, and attain support and comfort characteristics of a higher density, more expensive foam, through layer interactivity between foam and traditional coil spring arrangements, without locking the user into one fixed comfort level, but give him a wide choice between very hard and very soft comfort.

IFD and density modulation are achieved by manipulating flexible polyurethane foam or material of similar characteristics. This art teaches that this material is fashioned in a particular form and that it has to be of a molecular composition as to permit the extraction of air in the alveolate structure in a uniform manner, thus increasing material density equally uniformly. A further specialty of this material is that, by virtue of its structure, particular manufacturing and finishing processes, it affords in its low IFD number modulated state commensurably higher firmness stability, heretofore only associated with foam or similar material of a very much higher density number. Finally, it is much lighter in weight than the latter and can be reduced in size and volume for easy transport and storage.

This teaching also involves different reversible mattress combinations that one or more users may adjust differentially and individually to his or her liking, depending which side of the bed they choose to recline upon (left or right side of the bed, or the reverse surface). It also demonstrates that many incremental levels of firmness or softness may be achieved by one piece of foam as it changes from low density and high IFD to a high density low IFD more desirable foam, as well as when it interacts with other adjacent coil cores, changing their particular IFD and firmness characteristics.

In the present invention a custom fan-style vacuum pump that draws air out of the foam core to double its density and to reduce its IFD value considerably. After only a few seconds of the pump's operation the foam feels like a high density, resilient foam with an IFD of under 20, supported by an equally modulated coil spring layer with adjusted softness. Since the vacuum pump comes equipped with variable speed and remote control memory settings this transformation occurs at the speed and in increments desired by the user.

The experiments conducted entailed a user reclining on the foam/coil spring original firm configuration and subsequently adjusting the density and IFD settings within the foam core. It was observed that the user's heaviest parts of the body sank into the foam and were contoured progressively as the density increased and the IFD decreased. Thanks to this functionality, as well as the underlying coil spring layer, no collapsing or hammock effect took place within the mattress, which was lighter and thinner than any other mattresses using a different technology—reduction in weight, bulk and cost being industry priority requirements for new mattress technology.

This invention takes advantage of the adjustability of the self-inflating foam core as to comfort and also uses said adjustability to change the properties of the coil mattress above or below the foam mattress core. The structure of this combination allows the mattress cores to be used in two horizontal juxtaposed orientations. Either the foam part of the mattress faces upwards or the coil part of the mattress faces upwards. This is decided by the user of the mattress. In particular, air can be exhausted from the foam part of the mattress combination uniformly with the aid of a vacuum pump, which results in increasing the density of the foam core and decreasing the IFD within the core for a softer feeling foam core with more support. Since the coil core and the foam core are trapped within an airtight outer chamber the properties of said coil core will change as the foam core expands or contracts. Moreover, and like Arpin's teaching, the coil core combination of the mattress combination may additionally be compressed by evacuating the air of the chamber containing the coils which would result in increasing the hardness of that part of the mattress but would also affect the adjacent foam core. This interactivity in adjustability contributes greatly to the versatility of such a mattress combination.

The basic configuration of this invention, which comes in a broad variety of combinations between foam and spring coil cores and compartments, takes the form of a mattress, as one example of among a large number of support apparatuses, with at least three chambers each containing a valve communicably extending to the outside air. The valves contribute greatly to the versatility of the invention as will be explained further.

The first hermetically sealed chamber is an overall outer enclosure of the total mattress combination and will trap and compress the other two chambers if evacuated of air. A second chamber contains an assembly of coil springs, while a third chamber contains a core of self-inflating polyurethane foam. As mentioned above, the first layer encompasses the second and third layers tightly. If the chamber of self-inflating foam is allowed to inflate, it compresses the coil chamber trapped above or below it. By compressing the coils either directly by evacuating air with a vacuum from the coil chamber, or by compressing the coil chamber with the rising force of the self-inflating foam chamber, the coil portion of the mattress becomes firmer. On the other hand, if some air was evacuated from the foam chamber the coil portion would relax and feel softer.

DETAILED DESCRIPTION OF THE INVENTION

Figure 0:
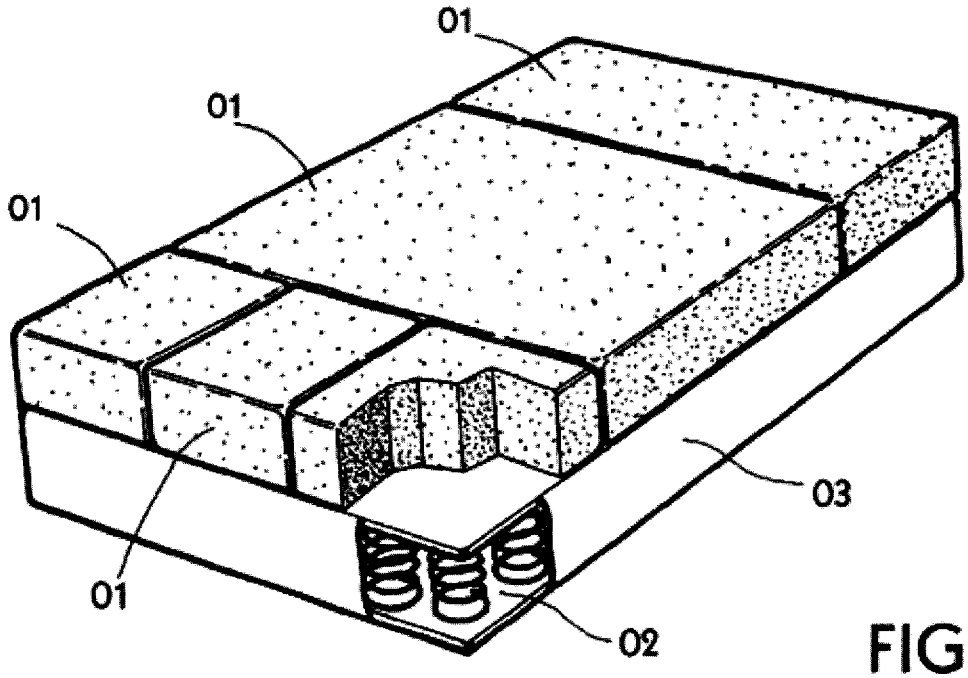
FIG. 0 shows a traditional mattress with different foam zones and coil spring core.

FIG. 0 shows a traditional mattress with a coil spring core and many diverse foam zones (01). The foam layers (01) typically have different density and IFD ratings to accommodate the weight of various parts of the body, such as the head, shoulders, middle body, and feet. The coil core (02) supports the above layers of foam and is surrounded by a quilted fabric or ticking (03) which is traditionally not airtight and serves as outer decoration as well as holds the parts of the mattress together as one whole mattress. Additionally (not shown), the whole mattress is typically surrounded by a quilted cover, for added comfort and aesthetics.

The disadvantages of said mattress is that it is often very expensive, and yet offers one fixed comfort level that can not be selectively modulated by the user. Yet other mattress inventions have interchangeable foam compartments to achieve different comfort levels, however said multi-foam compartment mattresses become cumbersome due to a multitude of foam compartments that must be stored when not in use.

Figure 1A:
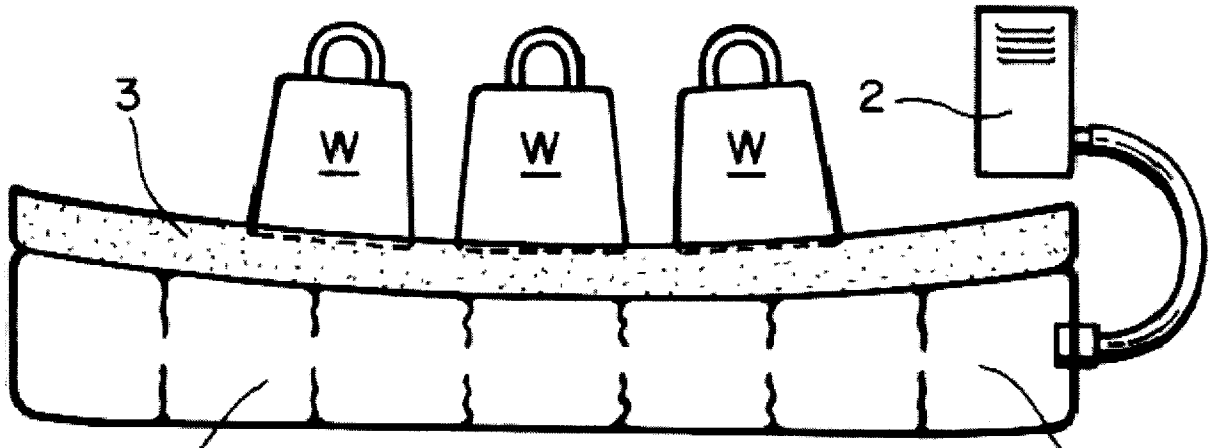
FIG. 1a PRIOR ART
FIGS. 1A and 1B shows air foam, and coil foam mattresses with weights placed upon their surface.

FIG. 1A shows a typical prior art foam-layer-plus-air-chamber mattress in which air bladders (1) can be pressurized by an air pump (2). The weights (W) represent a person reclining on top of the foam layer (3). The weights impress their mass on the mattress in the way a reclining person would, accumulating towards the area of least lateral support, that is, in the center. This results in a hammock effect, which is uncomfortable for a person resting on the mattress. Moreover, when air is let out of the bladder(s), the entire apparatus collapses and does no longer support the reclining body, the hammock effect being present all the way down through partial deflation. In this arrangement the air chamber is modulated below the foam layer without any interactive effect on the foam. In case of loss of pressure, the air chamber wobbles and sways, rendering the structure unstable and even more uncomfortable.

Figure 1B:
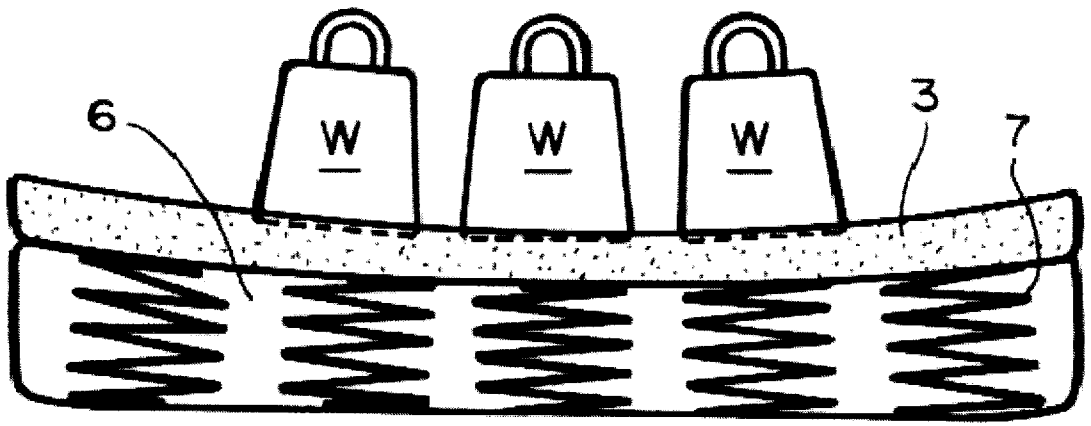
FIG. 1b PRIOR ART

FIG. 1B shows the same configuration as FIG. 1A, but in a combination of a traditional mattress chamber (6) with coil springs (7), and a layer of foam (3) on top for additional comfort. The weights (W) represent a person reclining on the mattress and create the hammock effect in the middle, because their force is greater than both underlying layers of air and coil springs can support without deformation. Deform they must, otherwise they would have to be rock hard and uncomfortable, defeating the basic purpose of a mattress. Both types of base layers will spring back immediately as soon as the weights are removed or only partially displaced, exerting a high upward pressure. This characteristic is undesirable in a mattress, too, because each movement of weight, such as found in a typical person's sleeping pattern, shifts the hammock effect around on the mattress.

In contrast to the above, this invention modulates the density and the spring-back-force (IFD) of self-inflating, open-cell, flexible polyurethane foam in combination with traditional coil spring chambers, thus doing away with these problems. Any weight distribution on top of such a foam & coil spring mattress, such as from the head, abdomen or the legs, affects the deflection of the foam layer surface only locally, and upward recovery (spring-back) is a slow process of re-directed airflow through the cell structure of the foam layer. The underlying coil spring layer is not subjected to concentrated pressure from the weights above it. Consequently, no hammock effect will be evidenced.

Depending on the volume of air in the foam layer, there can even be a state where no recovery takes place; where no upward pressure is exerted, and still a high level of comfort is sustained. This is based on the underlying principle inherent in the invention that, when air is removed progressively from a hermetically sealed foam core, the foam's density increases. At the same instance, its Indentation Force Deflection (IFD or spring-back force) is progressively decreased, making the foam core softer. This process of modulation spans from full inflation to practically zero. In the extreme case, when too much air is removed, the foam hardens, defeating the purpose of a mattress, e.g. to provide comfort.

The aim of the description of this invention is threefold: to show that modulation of air volume within the foam cells defeats the undesirable hammock effect, that it provides a sleeper with new, up to now unknown variety in choosing his level of comfort, and how traditional coil spring mattress chambers can be adjusted interactively for additional comfort, all this being achieved at the same time.

Figure 2:
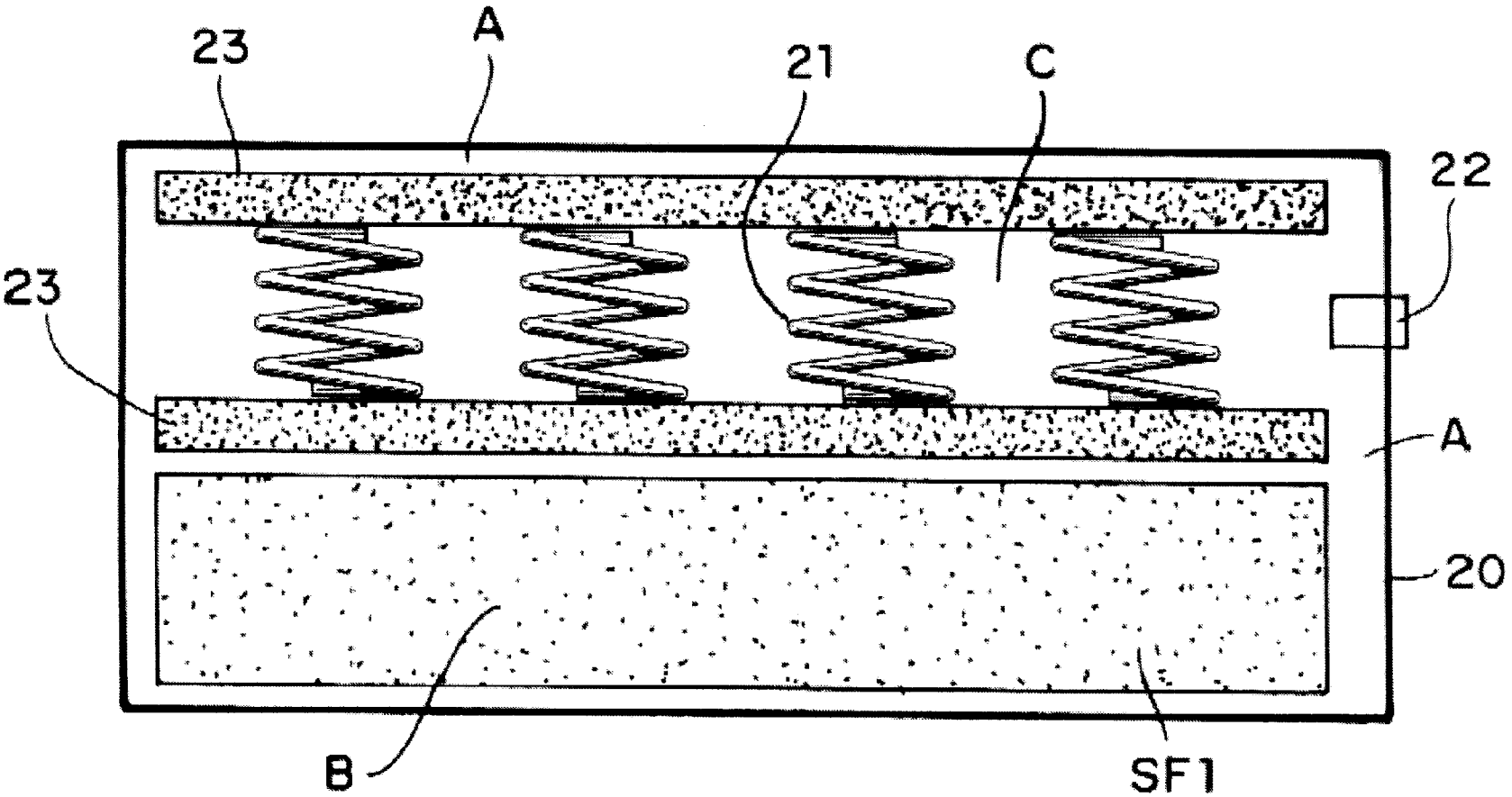
FIG. 2 shows one airtight chamber, two cores and a single valve.

FIG. 2 shows one airtight chamber with two cores inside. Chamber (A) is the main chamber constituting the overall mattress. The lower section (B) is a self-inflating foam core (SF1), above which is placed a coil spring section (C) with a number of coil springs (21), normally placed in individual fabric sleeves (not shown). Above and below the coil spring section protective layers (23) are provided to prevent the ends of the coil springs from protruding into a person lying on top of the chamber (A) and into the foam core (B) below.

A valve, or a plurality of valves (22), installed in the wall (20) of the main chamber (A), serves to exhaust air from the mattress. When air is exhausted through the valve, the foam core (SF1) will be compressed uniformly and the coil springs in the coil spring section will also be compressed. As a result, both density and IFD values of the two sections will change. The surface of the coil spring section will harden while, inversely, the surface of the foam core section will soften. This mattress may be used either with the foam or the coil spring section facing upwards.

Figure 3:
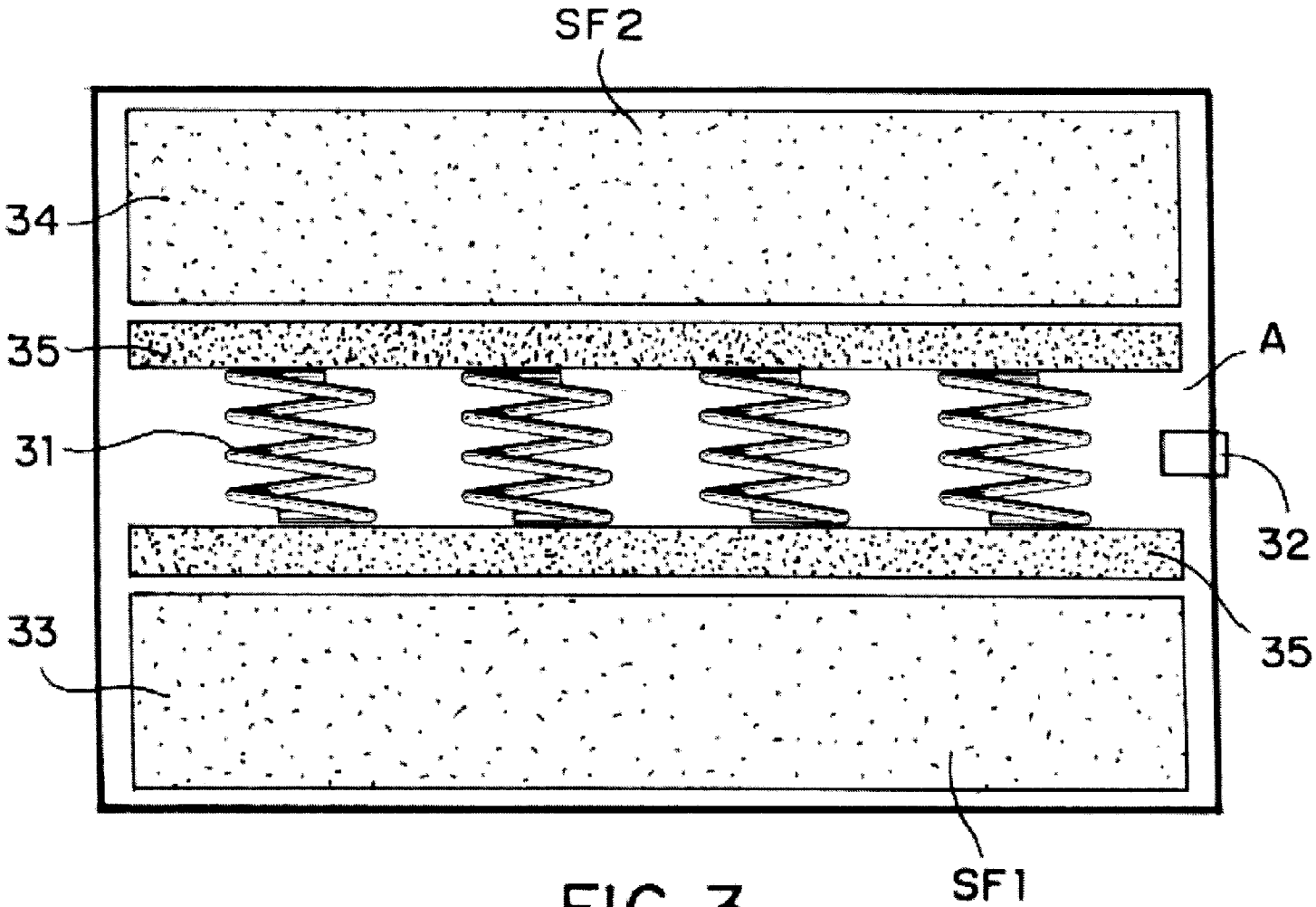
FIG. 3 shows one airtight chamber, three cores with a single valve.

FIG. 3 shows a combination mattress with one overall airtight chamber (A), in which are placed two self-inflating foam cores (SF1 and SF2) in the bottom (33) and the top (34) positions, while a coil spring core (31), having protective layers (35), is sandwiched in between. In the outer wall of chamber (A) a valve (32) has been provided through which air can be exhausted. When this occurs, the two foam cores (33 and 34) and the coil spring core springs (31) are compressed. Under compression, the surfaces of the foam cores will soften as a result of decreasing IFD, while the coil spring core, in contrast, will increase in hardness because the coil springs are tensioned and want to return to their initial relaxed state.

Figure 4:
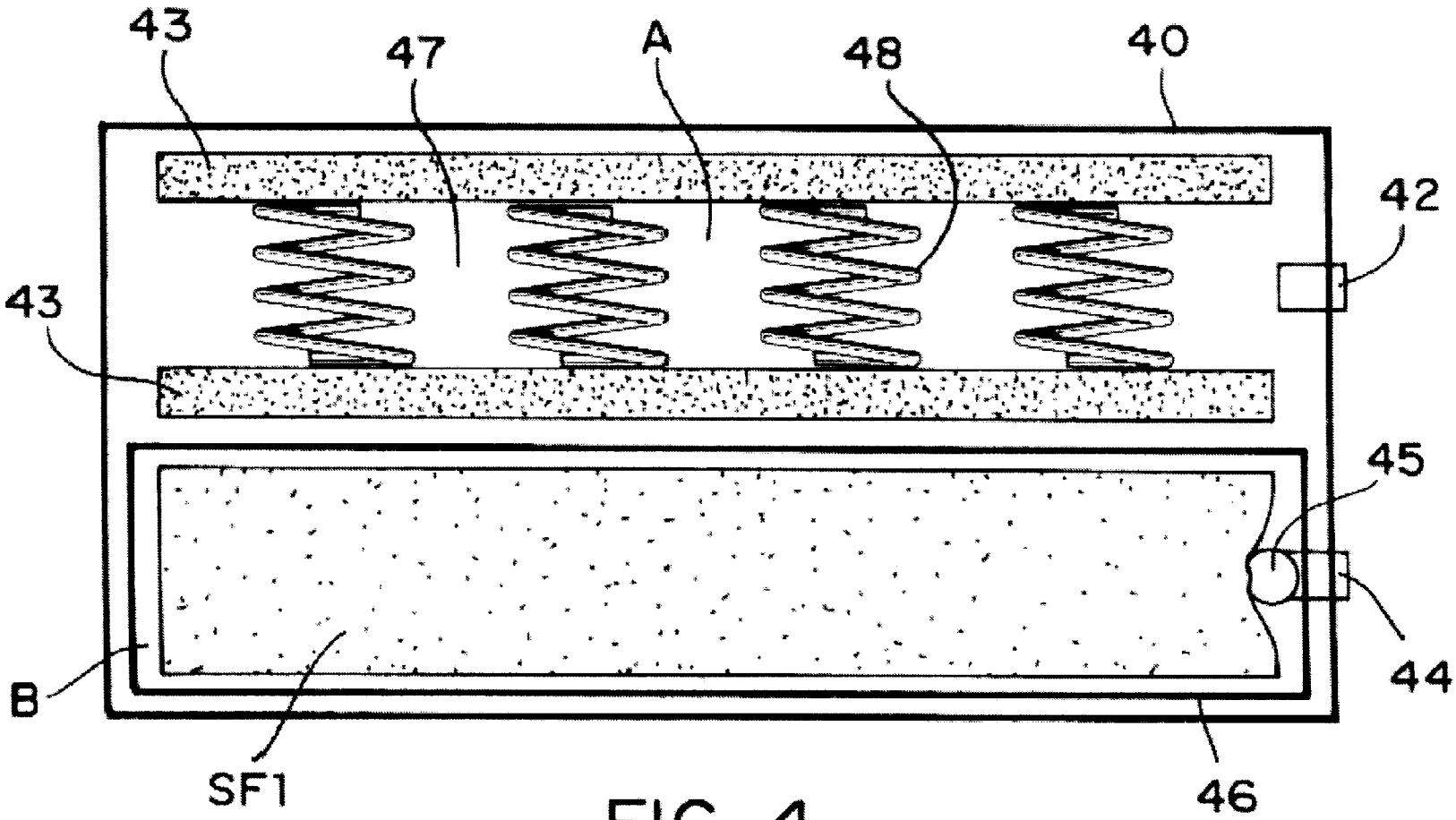
FIG. 4 shows two airtight chambers, two cores and two valves.

FIG. 4 shows a mattress combination with two chambers: an overall chamber (A) with wall (40), and a second chamber (B) inside. (B) is completely self-contained and envelopes a self-inflating foam core (SF1). The upper part of chamber (A) contains a coil spring core (47) with a number of coil springs (48). Protective layers (43) are placed each above and below the coil springs. Two valves (42 and 44) are provided, whereby upper valve (42) serves to exhaust air from the overall chamber (A), resulting in the compression of the upper coil spring core which will harden. Lower valve (44) serves to exhaust air from chamber (B) exclusively and independently from chamber (A), if so selected. Valve (44) leads to the interior of chamber (B) by penetrating both wall (40) of the overall chamber and wall (46) of chamber (B). This valve has an air permeable distancing element (45) attached its interior end to prevent valve-clogging by foam or cover material.

This mattress combination can be used on both sides. If so desired, the coil spring core can be used to lay on because of a desire of reclining on a harder surface, or the foam core side can be used because of a softer surface. When air is evacuated from the foam core (SF1) in chamber (B), both chambers will be rendered softer because of the falling IFD value in chamber (B), but also because the coil spring core (47) will relax further due to the shrinking volume in chamber (B).

Figure 5:
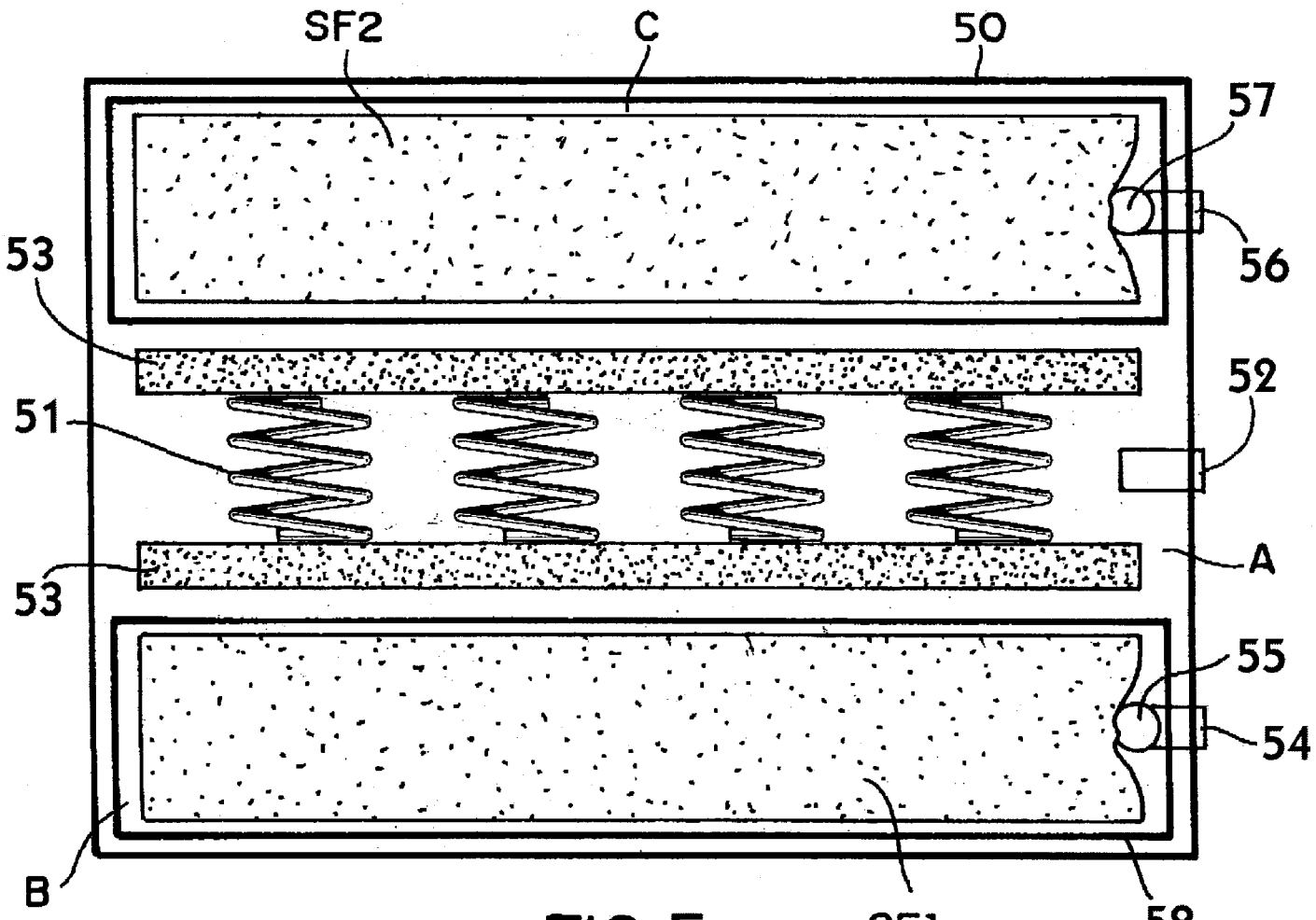
FIG. 5 shows three airtight chambers, three cores and three valves.

FIG. 5 shows a mattress combination with three chambers. The first (A) has an overall and sealed cover (50). Inside (A) are two chambers (B and C), each having a self-inflating polyurethane core (SF1 and SF2). Sandwiched between these is a traditional coil spring core (51) protected by foam layers (53) at both ends of the springs. (A) has a valve (52) for the purpose of evacuating air from that chamber, which will result in compressing the coil spring core, increasing its firmness. The upper and lower foam surfaces, being enveloped in separate chambers, remain unaffected. Chambers (B and C) also have independent valves (54 and 56), passing through both chamber walls into the interior of their respective foam core chamber, and each valve has an air permeable distancing element (55 and 57) attached. Through them air can be evacuated either from both chambers (B and C) simultaneously or independently, producing a large variety of different hardness or softness combinations. The sandwiched coil spring layer will be interactively modulated, since compression of either or both chambers (B) and (C) will result in a further extension of the springs.

Figure 6:
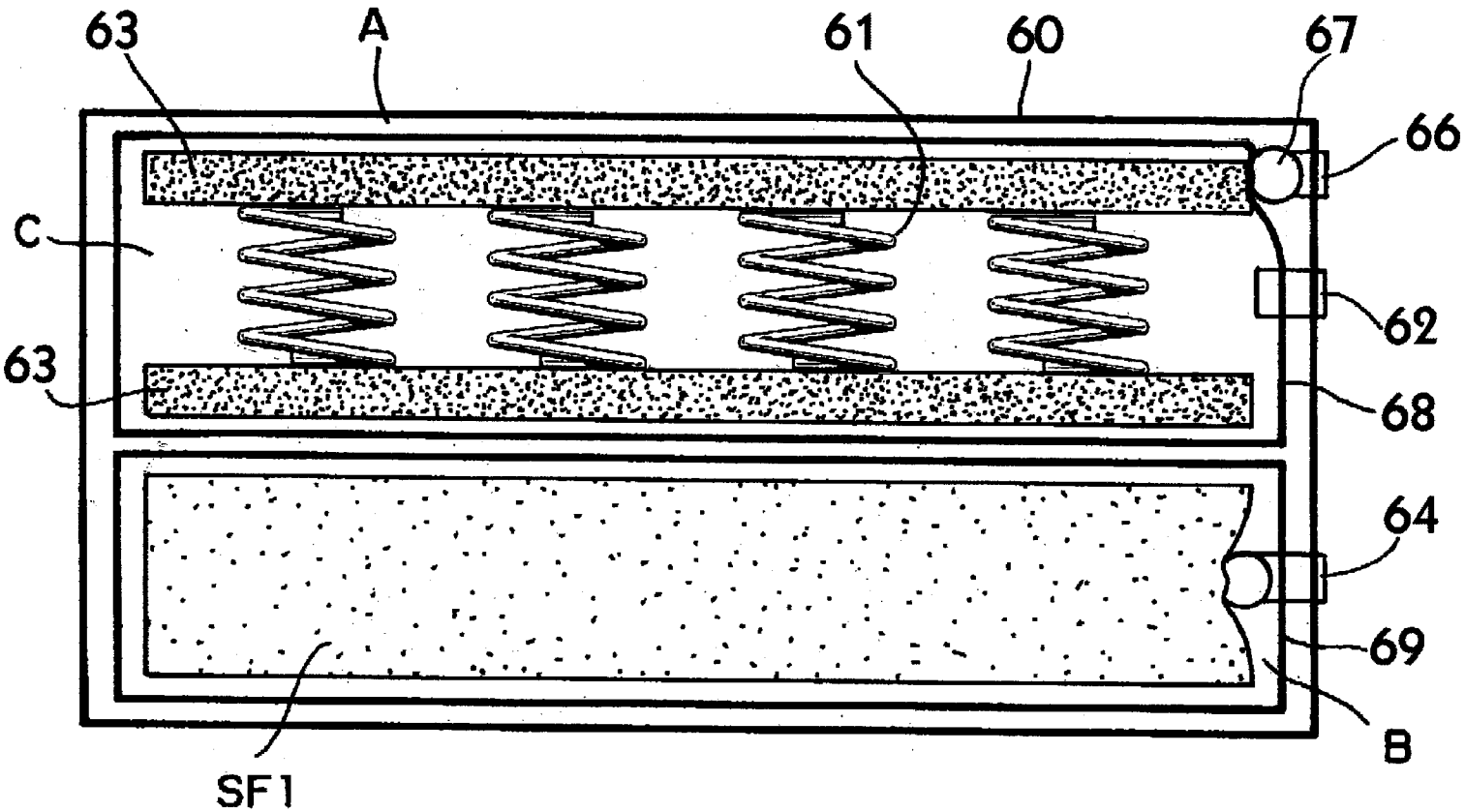
FIG. 6 shows three airtight chambers, two cores and three valves.

FIG. 6 shows a three chamber (A, B and C) combination mattress. (A) is the overall chamber enveloping the other two (B and C) and has sealed wall (60). The lower chamber (B) is filled with a self-inflating polyurethane foam core (SF1), enveloped in its own hermetically sealed cover. Inside the upper chamber (C) is a traditional coil spring core (61) and it also is hermetically sealed by its own cover (68). The coil spring core (61) has a protective foam layer (63) placed each above and below the springs. The overall chamber (A) has a valve (66) placed therein and through its own wall (60), fitted with an air permeable distancing element (67) on the interior, which prevents the cover (68) of chamber (C) from being drawn into the valve when the air is being evacuated from this chamber. Chamber (C) also has its own valve (62) which passes through both walls (60) of chamber (A) and (68) of (C).

Chamber (B) also has its own valve (64) passing through wall (60) of chamber (A) and wall (69) of chamber (B). Valve (64) is equally fitted with an air permeable distancing element to prevent the foam and covering from being drawn into the valve when air is evacuated from the foam core (SF1), and it serves, in the opposite case, to distances the foam and cover from the valve when the foam core is allowed to self-inflate. The versatility of this mattress combination resides in the fact that all three valves can be operated selectively to increase or decrease the respective softness and hardness of the various cores or to decompress the whole mattress for storage or transport.

When the air is evacuated from chamber (C), the coil springs (61) will be compressed, offering a higher degree of firmness. On the other hand, when the air is being evacuated from chamber (B), the self-inflating foam core (SF1) will soften but also allow chamber (C) to expand, offering a different level of softness/firmness combinations interactively. When air is being evacuated from (A), both chambers (B) and (C) will be compressed by the outer cover (60) and expel air, provided the respective chamber valves are open, resulting in the coil springs being harder to compress while the foam core will soften. The mattress can be used on either side if so desired.

Figure 7:
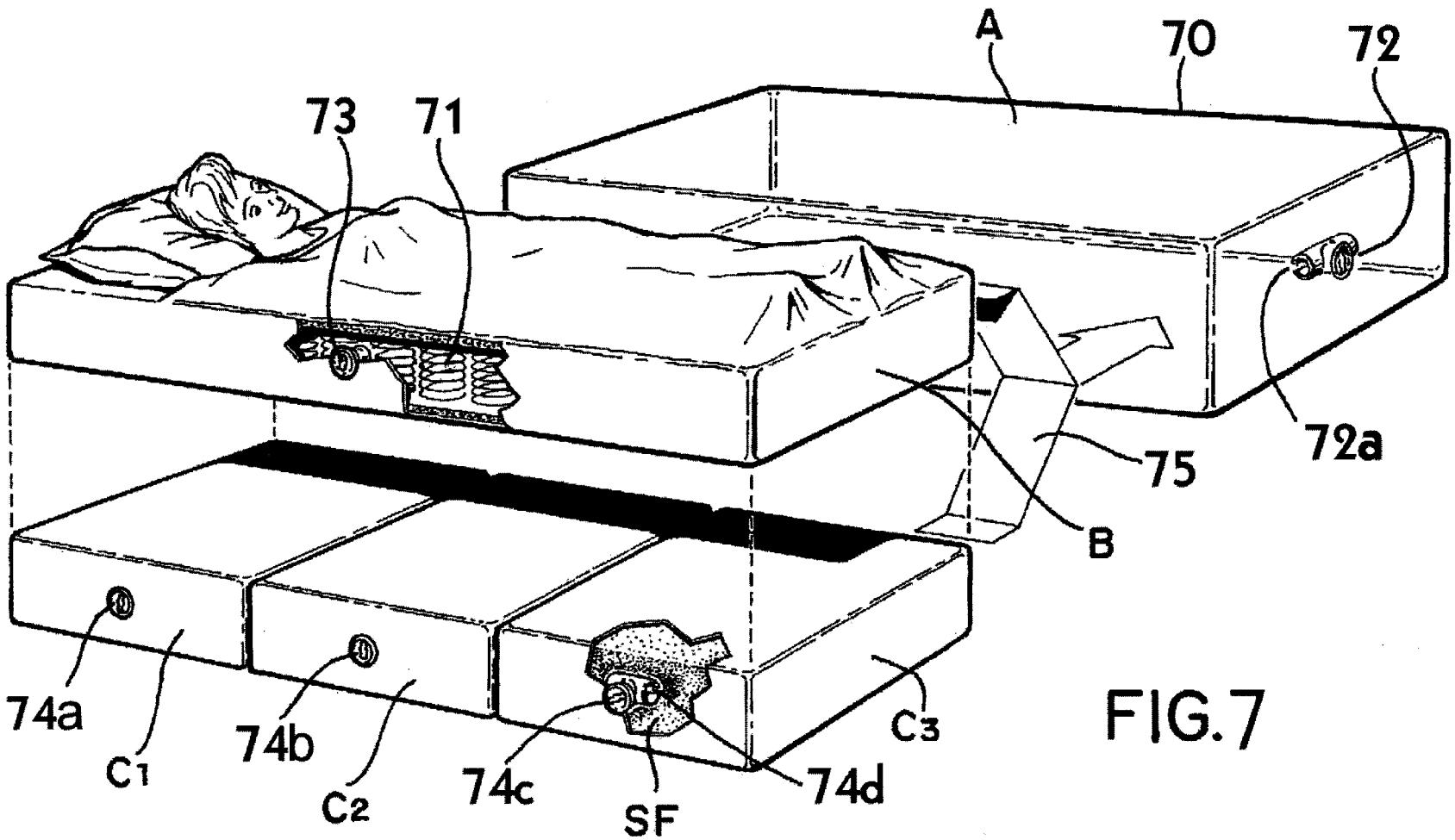
FIG. 7 shows subdivided chambers with a valve each.

FIG. 7 shows a mattress combination with 5 chambers which are hermetically sealed from each other. Overall chamber (A) with side wall (70) encloses four other chambers (B, C1, C2 and C3). Chamber (B) envelopes a traditional coil spring core (71) within its own sealed wall. Below it are placed three smaller self-inflating foam (SF) sections (C1, C2 and C3), each enclosed in their own outer wall envelopes. Arrow (75) indicates how the various cores and sections are associated with each other. The overall cover of chamber (A) has its own valve (72), combined with an air permeable distancing element (72*a*). Chamber (B) has its own valve (73) which passes through wall (70) of the outer chamber and through its own wall. The three smaller sections (C1, C2 and C3) below are filled with self-inflating foam and have their own valves (74*a*, 74*b* and 74*c*) and air permeable distancing elements (one is shown at 74*d*). Each valve of (C1, C2 and C3) pass though wall (70) of chamber (A) and through their own wall so that air can be evacuated from each chamber in a selective manner. The selectively modulable foam core chambers control various areas of hardness and softness of the coil spring layer, corresponding to upper, middle and lower body, thus greatly enhancing the versatility of the mattress.

Figure 8:
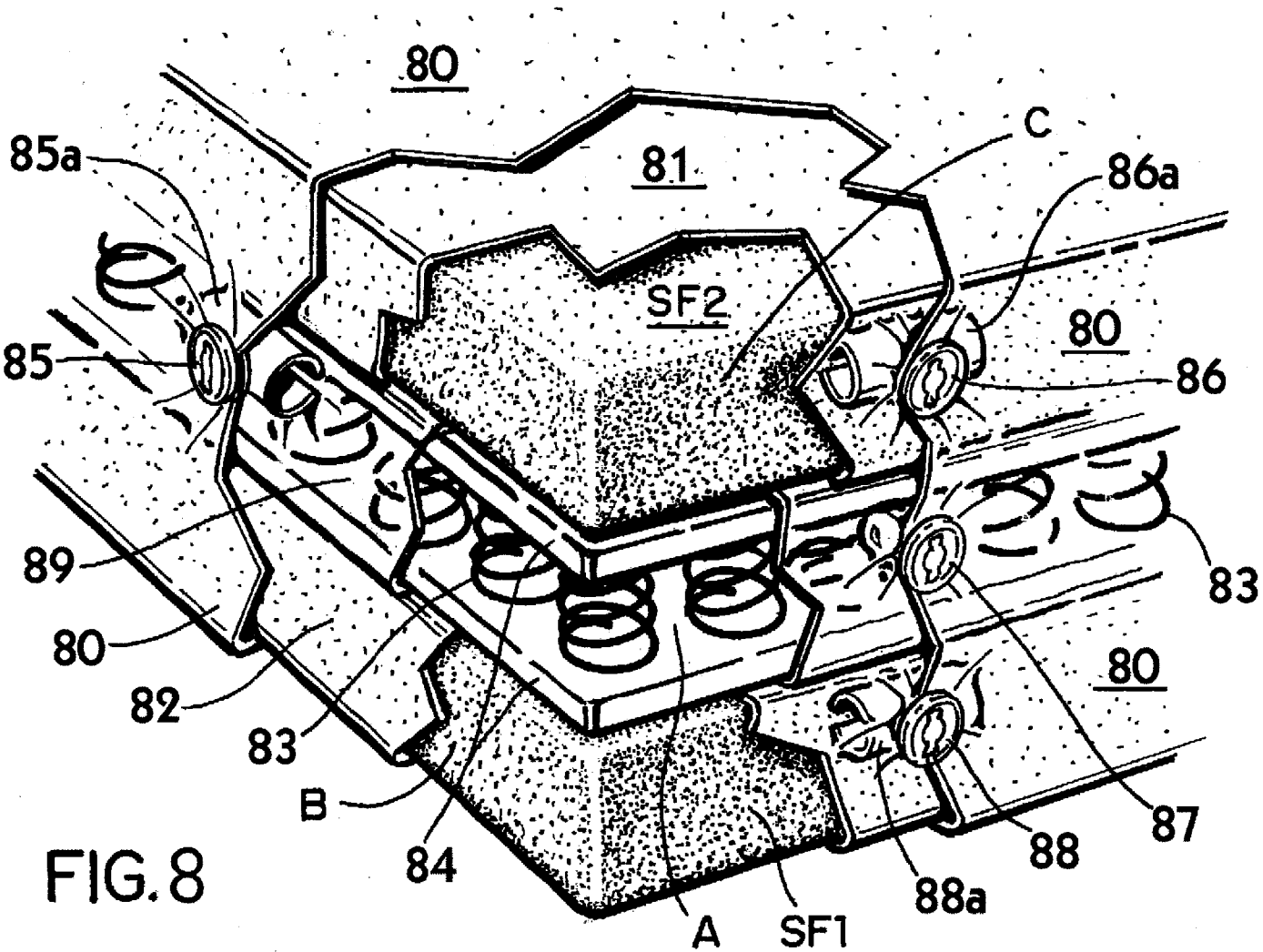
FIG. 8 shows a 4-chamber mattress in a cut-away view.

FIG. 8 shows a mattress combination in a cut-away view, consisting of four chambers. An outer chamber with wall (80) fully encloses and hermetically seals three inner chambers (A, B, and C). (B) is the lower chamber with its own wall (82), enclosing a self-inflating foam core (SF1). So is upper chamber (C) with wall (81), enveloping self-inflating foam core (SF2). The fourth chamber (A) with its own wall (89) envelops a traditional coil spring core, and it is sandwiched between chambers (B) and (C). The coil spring core has protective layers (84) placed one above and one below the spring ends.

All four chambers are fitted with valves to selectively evacuate air. Valve (85) in cover (80) is fitted with an air permeable distancing element (85*a*) to avoid being blocked by wall (89) of chamber (A) when air is evacuated. (85) is by purpose placed in a position that, when air is evacuated from its chamber, the other three chambers are compressed, provided their respective valves are open. The lower chamber (B) with wall (82), has valve (88) with anti-blockage distancing element (88*a*) passing into its interior through the outer wall (80) of the overall cover and its own (82). The upper chamber (C) with sealed cover (81) completely envelopes the self-inflating foam core (SF2). It has valve (86) with anti-clogging, air permeable, distancing element (86*a*), leading from its interior through its own wall (81) and through outer wall (80), so that only air from this chamber can be evacuated.

Chamber (A), which contains a traditional coil spring core, is sandwiched between (B) and (C). It has its own wall (89), completely enclosing the coil spring layer, so that air can only be withdrawn from it through valve (87). In order to so, this valve passes through its own wall (89) and outer wall (80). All four valves can selectively be activated to modulate the air volume in any one of the four chambers, providing new levels of versatility and comfort. This mattress may also be compressed for transport or storage.

Figure 9:
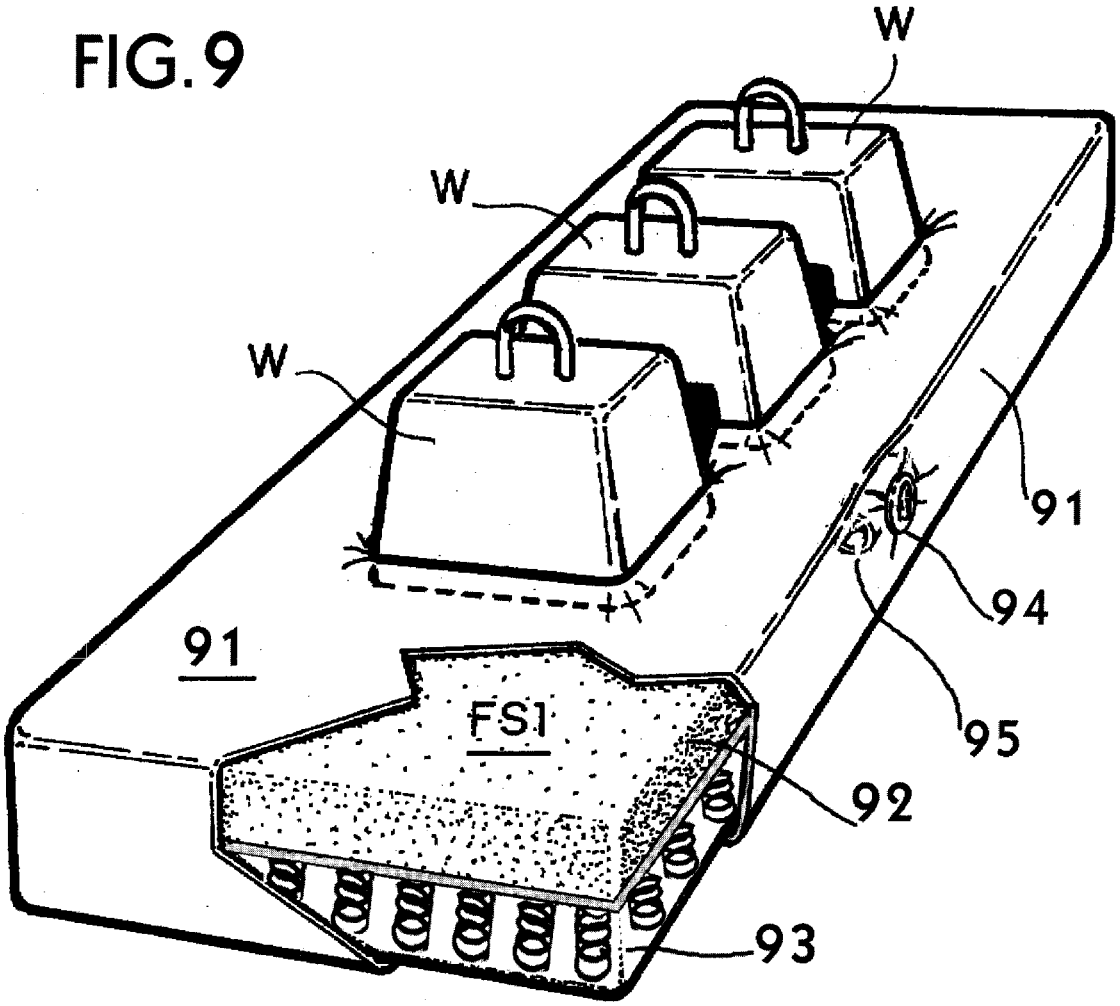
FIG. 9 shows a coil foam mattress in the present invention with weights placed on the surface.

FIG. 9 shows one configuration of the present invention with weights (W) simulating body parts sinking into the outer cover (91) and into the foam core (92) surface (FS1). The coil spring core (93) is supporting the foam, but if some air is withdrawn through valve (94) and through distancing element (95), the foam surface will become softer and contour the weights more so. In contrast, the coil section will also compress and become firmer giving the mattress extra support.

Figure 10:
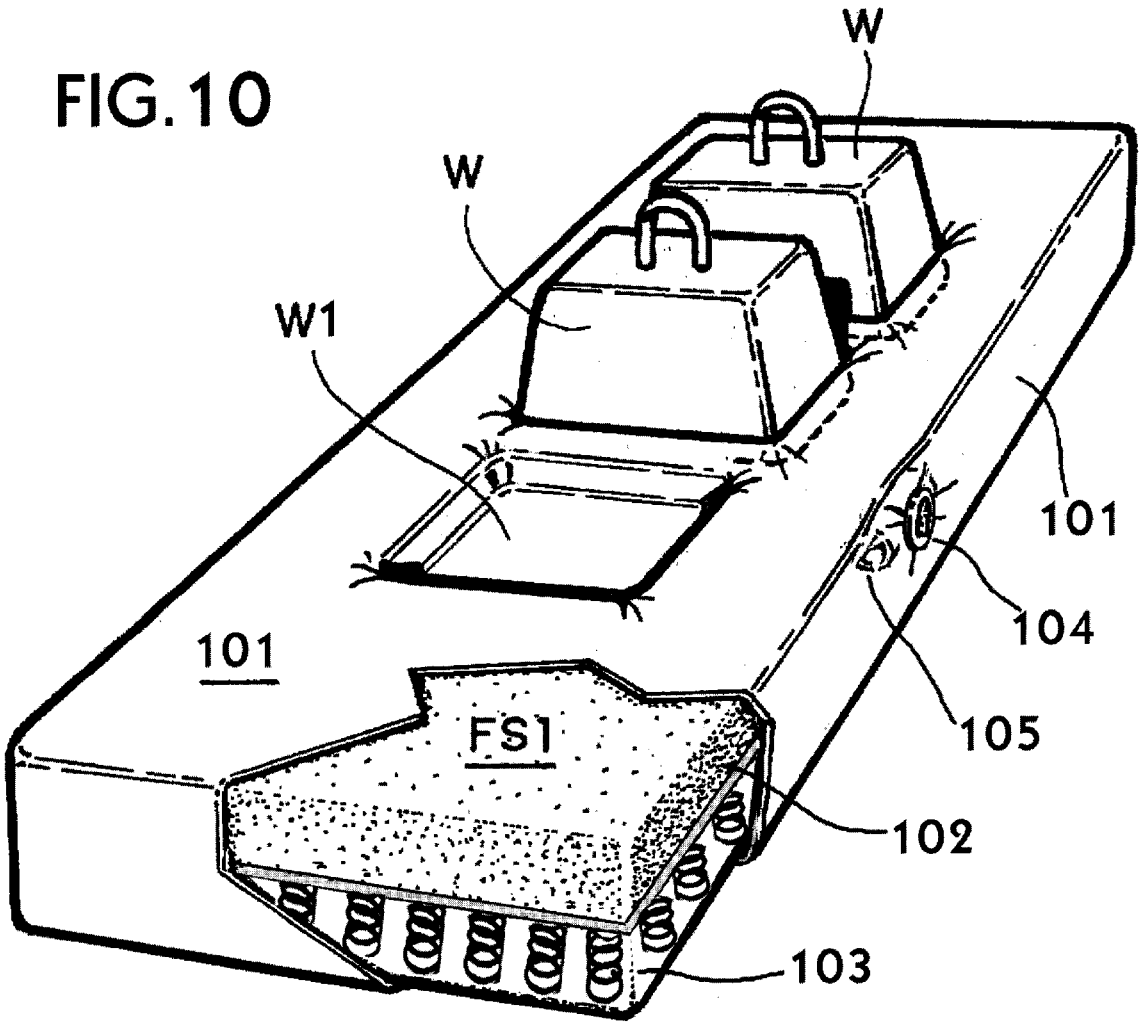
FIG. 10 shows a coil foam mattress in the present invention when weights are removed from the surface with the valve closed.

FIG. 10 shows the same configuration as in FIG. 9 but with one weight removed (W1), the valve (104) is closed, and the foam core (102) and surface (FS1) exhibit the imprint of the users body, as the foam core (102) recovers slowly upwards.

On the other hand the coil core (103) when air is removed from outer chamber (101) through valve (104) and distancing element (105) will be compressed and offer more upward support.

It is also possible to evacuate additional air from this mattress structure, and observe the imprint of the user's body remain on surface (SF1), hence exhibiting no upward recovery.

Figures 11, 11A, 11B:
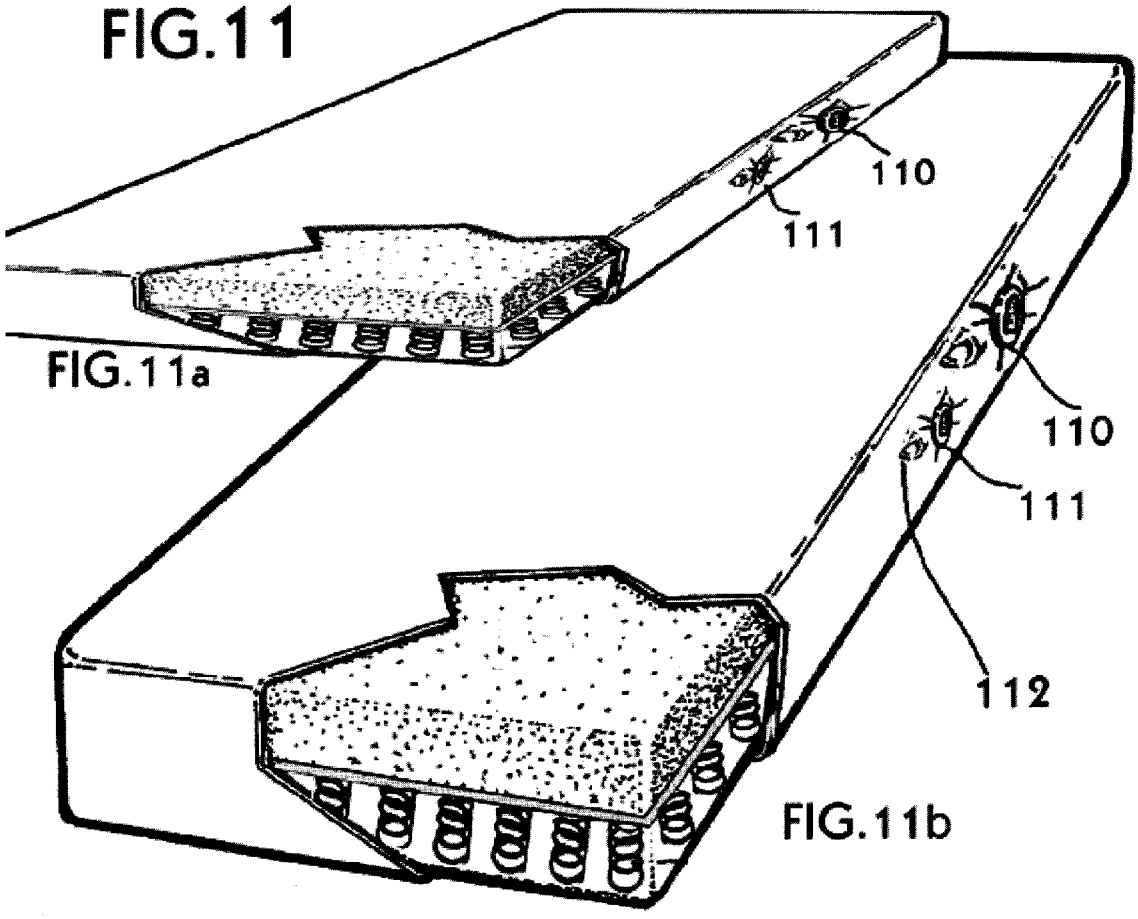
FIGS. 11*a* and 11*b* shows the same combination mattress in different states of self-inflation with one or more valves and one or more air permeable distancing elements.

FIG. 11*a*, shows a foam coil combination mattress in its compressed and deflated state with one or more valves (110) (111) fitted onto the chamber wall and one or more air permeable distancing elements to prevent clogging. Valve (110) is larger than valve (111) and may be used for rapid inflation whereas valve (111) may be used to modulate the mattress combination as well as to inflate it.

FIG. 11*b*, shows the same foam coil combination mattress in its inflated state with one or more inflation valves (110) (111) and one or more air permeable distancing elements (112 shown only) to prevent clogging.

While the description of the patent dwells at length on different applications in mattresses, other applications are not excluded, such as seats of all sorts, cushioning in all forms as well as any other application requiring a support apparatus for the enhancement of comfort and versatility.

What we claim is:

1. A mattress with layer combinations, comprising one or more hermetically sealed chambers, a first of said chambers having an airtight outer covering enclosing all other chambers, said first chamber having at least one core of self-inflating polyurethane foam that is density and IFD adjustable located therein, and having at least one core of coil springs located therein, and having at least one valve fitted in a wall of said first chamber serving as a means to evacuate air; and a vacuum communicably connected to each said valve outside of said covering; at least one said valve being opened for allowing air to pass to and from said foam core and at least one said valve being opened for allowing air to pass to and from said coil spring core when said vacuum is deactivated and activated respectively; said vacuum being activated for exhausting air from said foam core in a selected quantity to constrict and partially deflate said foam core and being deactivated for allowing a foam core that is at least partially collapsed to draw air in through said valve and inflate, said valve being selectively closed with said foam core in one of a plurality of fully self-inflated and partially deflated states to maintain a desired air pressure within said foam core, whereby corresponding levels of density and IFD are selectively exhibited within said core, at least one such level in a partially collapsed state providing said foam core with a viscoelastic foam feel; said vacuum being activated for exhausting air from said coil spring core to increase the firmness of said coil spring core, whereby said respective cores may be individually adjusted in a selected manner.

2. The mattress combination of claim 1, including one additional chamber containing a self-inflating foam core which is hermetically sealed.

3. The mattress combination of claim 2, including one or more valves fitted to each chamber, constituting means for selectively evacuating air from each of said chambers using a vacuum pump.

4. The mattress combination of claim 2, wherein one or more valves penetrate through the wall of the outer covering and through their own second chamber wall communicating with the interior of the foam core chamber.

5. The mattress combination of claim 2, including two additional chambers within the first chamber, wherein a self-inflating foam core is placed in the first additional chamber and a core of coil spring in the second additional chamber, and are both hermetically sealed from each other and from said first chamber.

6. The mattress combination of claim 5, including one or more valves fitted to each chamber, constituting means for selectively evacuating air from each of said chambers using a vacuum pump.

7. The mattress combination of claim 1, including two additional chambers within the first chamber, wherein self-inflating foam cores are placed in each of the two additional chambers, said additional chambers are individually hermetically sealed from each other and from said first chamber.

8. The mattress combination of claim 1, wherein one or more valves fitted to the first chamber only penetrate through their own wall.

9. The mattress combination of claim 1, wherein the core of self-inflating foam is subdivided into at least three hermetically sealed sections and, forming with the coil spring core a four part whole mattress, each part having its own chamber.

10. The mattress combination of claim 9, wherein each of the subdivided sections have at least one valve fitted to their own chamber wall to communicate with the outside air.

11. The mattress combination of claim 1, wherein the foam density and IFD values which are factory preset in their original configurations can be selectively modulated through the removal of air.

12. The mattress combination of claim 1, including one or more air permeable distancing elements that separate the valves fitted to the chamber walls from any adjacent materials.

13. The mattress combination of claim 12, wherein said air permeable distancing elements are communicably attached to the valves.

14. The mattress combination of claim 1, wherein an evacuation of some air from the foam core chamber, with said valve closed results in the core's slow recovery after depression, and alters the tension of the coil spring core.

15. The mattress combination of claim 1, wherein said self-inflating foam core, as it is expanding and increasing in volume, constitutes a means to compress any other chamber directly adjacent to it.

16. The mattress combination of claim 1, wherein said self-inflating foam core, when reduced in volume by removing some air, constitutes a means to allow any other adjacent chamber to expand.

17. The mattress combination of claim 1, wherein said coil spring core, as it is expanding and increasing in volume, constitutes a means to compress any other chamber directly adjacent to it.

18. The mattress combination of claim 1, wherein said coil spring core, when reduced in volume by removing some air, constitutes a means to allow any other adjacent chamber to expand.

19. The mattress combination of claim 1, wherein each chamber can be emptied of air with a vacuum pump to facilitate transport and storage.

20. The mattress combination of claim 1, wherein a plurality of chambers and cores are placed in a longitudinal or lateral orientation each of which can be individually and selectively modulated as to comfort.

21. A mattress with layer combinations, comprising one or more hermetically sealed chambers, a first of said chambers having an airtight outer covering enclosing all other chambers, said first chamber having at least one core of self-inflating polyurethane foam located therein, and having at least one core of coil springs located therein, and having at least one valve fitted in a wall of said first chamber serving as a means to evacuate air, said mattress including two additional chambers within the first chamber, wherein self-inflating foam cores are placed in each of the two additional chambers, said additional chambers being individually hermetically sealed from each other and from said first chamber; and further including a coil spring core placed between the two additional chambers in the manner of a sandwich.

22. The mattress combination of claim 21, including one or more protective layers placed one above and one below said coil spring core.

23. The mattress combination of claim 21, wherein the coil spring core is fully enclosed in a further additional chamber, hermetically sealed from the other chambers, thereby constituting a combination of four chambers.

24. A mattress with layer combinations, comprising one or more hermetically sealed chambers, a first of said chambers having an airtight outer covering enclosing all other chambers, said first chamber having at least one core of self-inflating polyurethane foam located therein, and having at least one core of coil springs located therein, and having at least one valve fitted in a wall of said first chamber serving as a means to evacuate air; said mattress including one additional chamber containing a self-inflating foam core which is hermetically sealed; and further including two additional chambers within the first chamber, wherein a self-inflating foam core is placed in the first additional chamber and a core of coil spring in the second additional chamber, said foam core and said coil spring core being hermetically sealed from each other and from said first chamber; and one or more valves penetrating through the wall of the outer covering and through their own third chamber covering communicating with the interior of the coil spring chamber.

* * * * *